US008807703B2

(12) United States Patent
Okamoto et al.

(10) Patent No.: US 8,807,703 B2
(45) Date of Patent: Aug. 19, 2014

(54) LIQUID EJECTION APPARATUS

(75) Inventors: Katsumi Okamoto, Azumino (JP); Masanori Nakata, Matsumoto (JP); Yoshikane Tsuchihashi, Matsumoto (JP); Takafumi Ogimura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 40 days.

(21) Appl. No.: 13/405,553

(22) Filed: Feb. 27, 2012

(65) Prior Publication Data

US 2012/0218348 A1 Aug. 30, 2012

(30) Foreign Application Priority Data

Feb. 28, 2011 (JP) ..... 2011-042296

(51) Int. Cl.

| | |
|---|---|
| ***B41J 2/165*** | (2006.01) |
| ***B41J 29/13*** | (2006.01) |
| ***B41J 29/02*** | (2006.01) |
| ***B41J 2/17*** | (2006.01) |
| ***B41J 2/185*** | (2006.01) |

(52) U.S. Cl.

CPC ..... *B41J 2/16523* (2013.01); *B41J 29/02* (2013.01); *B41J 2/1721* (2013.01); *B41J 2/16508* (2013.01); *B41J 2/185* (2013.01)

USPC ..... 347/36; 347/108

(58) Field of Classification Search

USPC ..... 347/36, 101, 108

See application file for complete search history.

(56) References Cited

U.S. PATENT DOCUMENTS

| | | | | |
|---|---|---|---|---|
| 5,223,859 | A * | 6/1993 | Yoshimura et al. | 347/108 |
| 5,731,829 | A * | 3/1998 | Saito et al. | 347/104 |
| 5,757,399 | A * | 5/1998 | Murayama et al. | 347/32 |
| 6,220,314 | B1 * | 4/2001 | Sato | 141/351 |
| 6,234,626 | B1 * | 5/2001 | Axtell et al. | 347/108 |
| 6,257,717 | B1 * | 7/2001 | Axtell et al. | 347/108 |
| 6,264,322 | B1 * | 7/2001 | Axtell et al. | 347/108 |
| 6,493,937 | B1 * | 12/2002 | Axtell et al. | 29/890.1 |
| 6,676,236 | B1 * | 1/2004 | Uchikata | 347/5 |
| 6,789,876 | B2 * | 9/2004 | Barclay et al. | 347/37 |
| 6,824,242 | B1 * | 11/2004 | Silverbrook | 347/32 |
| 7,604,344 | B2 * | 10/2009 | Seki et al. | 347/103 |
| 7,681,982 | B2 * | 3/2010 | Suzuki | 347/36 |
| 7,850,300 | B2 * | 12/2010 | Hiroki et al. | 347/104 |
| 7,918,518 | B2 * | 4/2011 | Tanahashi et al. | 347/8 |
| 8,016,503 | B2 * | 9/2011 | Silverbrook | 400/693 |
| 8,118,423 | B2 * | 2/2012 | Hiroki et al. | 347/104 |

(Continued)

FOREIGN PATENT DOCUMENTS

JP 06-234209 8/1994

*Primary Examiner* — Matthew Luu
*Assistant Examiner* — Patrick King
(74) *Attorney, Agent, or Firm* — Workman Nydegger

(57) ABSTRACT

A liquid ejection apparatus includes an apparatus main body, a liquid ejection head which is provided on the apparatus main body and ejects liquid onto a recording medium, a draw-out path which is provided on the apparatus main body, a waste liquid unit which is provided on the draw-out path in a detachable manner and reserves waste liquid wastefully ejected from the liquid ejection head, an opening from which a transportation path for transporting the recording medium is exposed, and an opening/closing unit which is provided to be capable of opening and closing the opening, and at least a part of which is located on the draw-out path and covers at least a part of the waste liquid unit in a state where the waste liquid unit is attached to the draw-out path and the opening is closed.

5 Claims, 10 Drawing Sheets

(56) References Cited

U.S. PATENT DOCUMENTS

2005/0062794 A1* 3/2005 Kanamitsu et al. ..... 347/31
2005/0146591 A1* 7/2005 Ogata et al. ..... 347/108
2007/0008371 A1* 1/2007 Ishihara ..... 347/29
2007/0031288 A1* 2/2007 Ishihara ..... 422/68.1
2007/0035578 A1* 2/2007 Suzuki ..... 347/36
2007/0263051 A1* 11/2007 Kawai et al. ..... 347/86
2009/0219337 A1* 9/2009 Harada et al. ..... 347/36
2009/0219339 A1* 9/2009 Harada ..... 347/36
2009/0256884 A1* 10/2009 Aoki ..... 347/23

* cited by examiner

LIQUID EJECTION APPARATUS

BACKGROUND

1. Technical Field

The present invention relates to a liquid ejection apparatus which ejects liquid onto a recording medium, in particular, relates to a liquid ejection apparatus including a waste liquid unit for reserving waste liquid which has been wastefully ejected from a liquid ejection head.

2. Related Art

There is a recording apparatus as an example of a liquid ejection apparatus and there is an ink jet printer as an example of the recording apparatus. In the ink jet printer, ink discharged from an ink jet recording head does not always land onto a recording paper as an example of a recording medium in some case. In other words, ink is wastefully ejected at a predetermined portion intentionally in some case.

For example, in an ink jet printer which can execute so-called borderless recording in which recording is performed on the entire recording paper without margins, a groove is formed on an upper surface of a supporting member (platen) arranged so as to be opposed to an ink jet recording head. Further, in such ink jet printer, ink discharged onto a region deviated from edges of the recording paper is wastefully ejected into the groove. An ink discharge hole is provided on a bottom of the groove and ink which has been wastefully ejected into the groove is discharged to the lower side through the ink discharge hole so as to be introduced to a waste liquid unit which reserves waste liquid.

Whether or not an ink jet printer executes the borderless recording, a maintenance unit which performs maintenance on an ink jet recording head is provided in the ink jet printer. The maintenance unit includes a capping unit which caps the ink jet recording head and a pump unit which generates a negative pressure in a cap. The maintenance unit sucks ink through an ink discharge hole on the ink jet recording head and discharges the sucked ink to a waste liquid unit.

If waste ink is repeatedly discharged as described above, the waste liquid unit is filled with waste liquid. When the waste liquid unit is filled with waste liquid, subsequent recording operations cannot be executed. In particular, since an ink jet printer for business use is required to have longer lifetime, it is important to manage a waste ink reservation amount in the waste liquid unit.

Then, an ink jet recording apparatus in which the waste liquid unit is provided on a printer main body in a detachable manner, and a user can exchange the waste liquid unit when the waste liquid unit is filled with waste liquid has been already proposed (JP-A-6-234209).

As for lifetimes of parts used in an ink jet printer, an exchange frequency of the waste liquid unit is extremely less in comparison with an exchange frequency of an ink cartridge, for example, in general. On the other hand, since the waste liquid unit reserves waste liquid, there are risks that user's hands may possibly become dirty at the time of exchange and an inner portion of the apparatus is caused to be contaminated. In addition, if the waste liquid unit is detached carelessly while a maintenance operation is being executed on the ink jet recording head, there arises a risk that waste liquid flows out into the apparatus from an ink tube that is introducing the waste liquid to the waste liquid unit.

In addition, when a user performs an operation of exchanging the waste liquid unit, a controller of the ink jet printer needs to grasp a waste liquid reservation amount in the waste liquid unit. Then, when the waste liquid unit is filled with waste liquid, the controller is required to notify the user of that filled-up. In order to execute the above operation, for example, it is considered that a memory unit (IC chip) which holds information relating to the waste liquid reservation amount must be provided on the waste liquid unit and information relating to an expected waste liquid amount is written into the memory unit when an operation in which waste liquid is generated is executed.

However, if the waste liquid unit is drawn out while information is being written into the memory unit, the information cannot be written into the memory unit properly. Then, the waste liquid reservation amount in the waste liquid unit cannot be grasped properly. As a result, there arises a risk that waste liquid overflows in the apparatus.

Accordingly, considering the above situation, it is preferable that attachment and detachment of the waste liquid unit be performed requisite minimum times essentially. However, if the waste liquid unit is configured to be detachable, the waste liquid unit is exposed to an outer surface of an apparatus main body of the ink jet printer. Therefore, a user is easy to mistakenly draw out the waste liquid unit by mistake.

Further, in order to prevent the waste liquid unit from being drawn out carelessly, the following configuration can be considered to be employed, for example. That is, an openable and closable cover which opens and covers the waste liquid unit is provided and a sensor dedicated to detect opening and closing of the cover is provided. With this, at least a possibility that the waste liquid unit is drawn out is detected in advance. When the sensor detects the possibility that the waste liquid unit may be drawn out, the operation of the maintenance unit is stopped immediately.

With this configuration, at least flow-out of waste liquid in the apparatus, which is caused when the waste liquid unit is drawn out while the maintenance operation is being executed on the ink jet recording head, can be prevented from occurring. However, in this case, the apparatus is largely increased in cost, and in addition, this configuration may lead to the waste of resources and is not preferable since the waste liquid unit is rarely exchanged.

SUMMARY

An advantage of some aspects of the invention is to provide an apparatus at low cost in which a waste liquid unit is provided in a detachable manner and the waste liquid unit can be prevented from being drawn out carelessly.

A liquid ejection apparatus according to a first aspect of the invention includes an apparatus main body, a liquid ejection head which is provided on the apparatus main body and ejects liquid onto a recording medium, a draw-out path which is provided on the apparatus main body, a waste liquid unit which is provided on the draw-out path in a detachable manner and reserves waste liquid wastefully ejected from the liquid ejection head, an opening from which a transportation path for transporting the recording medium is exposed, and an opening/closing unit which is provided to be capable of opening and closing the opening, and at least a part of which is located on the draw-out path and covers at least a part of the waste liquid unit in a state where the waste liquid unit is attached to the draw-out path and the opening is closed.

According to the aspect of the invention, at least a part of the opening/closing unit is located on the draw-out path and covers at least a part of the waste liquid unit in a state where the waste liquid unit is attached to the apparatus main body and the opening/closing unit closes the opening. Therefore, in order to draw out the waste liquid unit, a user needs to open the opening/closing unit first. Accordingly, the waste liquid unit can be prevented from being carelessly and easily drawn out.

Further, the opening/closing unit exposes the transportation path of the recording medium therefrom for performing a paper jam processing. An opening and closing frequency of the opening/closing unit is extremely less and an opening and closing timing is irregular. Therefore, the waste liquid unit can be prevented more effectively from being carelessly and easily drawn out.

It is to be noted that the opening/closing unit exposes the transportation path of the recording medium therefrom for performing the paper jam processing and is not a cover dedicated to the waste liquid unit. Therefore, cost of the apparatus is not increased.

Further, since the opening/closing unit exposes the transportation path of the recording medium therefrom for performing the paper jam processing, the recording medium cannot be transported properly in a state where the opening/closing unit opens. That is to say, if the recording medium is transported in the state where the opening/closing unit opens, a user can easily recognize that the opening/closing unit opens.

Therefore, a recording operation on the recording medium can be prevented from being performed continuously for a long period of time in a state where the waste liquid unit is drawn out. With this, a large amount of waste liquid is prevented from being flown out in the apparatus. In addition, a sensor dedicated to detect an opening and closing state of the opening/closing unit is not required to be provided.

According to a second aspect of the invention, in the liquid ejection apparatus according to the first aspect of the invention, it is preferable that the opening/closing unit form a part of the transportation path.

According to a third aspect of the invention, in the liquid ejection apparatus according to the first and second aspects of the invention, it is preferable that the waste liquid unit have a hook portion serving as a hook when the waste liquid unit is drawn out, and the opening/closing unit cover the hook portion in a state of the opening being closed.

According to the aspect of the invention, the hook portion serving as the hook when the waste liquid unit is drawn out is formed on the waste liquid unit. The hook portion is covered by the opening/closing unit. Therefore, the waste liquid unit can be prevented more effectively from being carelessly and easily drawn out.

According to a fourth aspect of the invention, in the liquid ejection apparatus according to the first to third aspects of the invention, it is preferable that the waste liquid unit be provided in a state of being biased by a biasing unit in a detachment direction, and the waste liquid unit be engaged with the opening/closing unit which is in a state of closing the opening so as to be fixed at an attachment position on the apparatus main body.

According to the aspect of the invention, the waste liquid unit is provided in the state of being biased by the biasing unit in the detachment direction and the waste liquid unit is engaged with the opening/closing unit which is in the state of closing the opening so as to be fixed at the attachment position on the apparatus main body. In other words, the waste liquid unit cannot be made in an attached state by itself. Therefore, the waste liquid unit can be also used as a unit which detects an opening and closing state of the opening/closing unit.

According to a fifth aspect of the invention, in the liquid ejection apparatus according to the first to fourth aspects of the invention, it is preferable that a memory unit which holds information relating to an amount of waste liquid reserved in the waste liquid unit be provided on the waste liquid unit, and the waste liquid unit be accessible to the memory unit when the waste liquid unit is attached to the apparatus main body of the liquid ejection apparatus.

According to the aspect of the invention, the memory unit which holds information relating to a waste liquid amount is provided on the waste liquid unit and the memory unit is accessible when the waste liquid unit is attached to the apparatus main body of the liquid ejection apparatus. Therefore, when the waste liquid unit is filled with waste liquid, a warning indicating that filled-up can be issued to a user.

Further, the memory unit is not accessible in a state where the waste liquid unit is detached. Therefore, the memory unit for obtaining the reserved waste liquid amount in the waste liquid unit can be also used as a unit which detects whether or not the waste liquid unit is attached. As a result, a processing operation during which waste liquid is generated is set not to be performed, for example, when the waste liquid unit is not attached. This makes it possible to prevent the waste liquid from flowing out in the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to drawings. However, the invention is not limited to the following embodiment and various variations can be made within the range of the invention described in the scope of the invention. One embodiment of the invention is described below based on the assumption that such variations are encompassed in the range of the invention.

Figure 1:
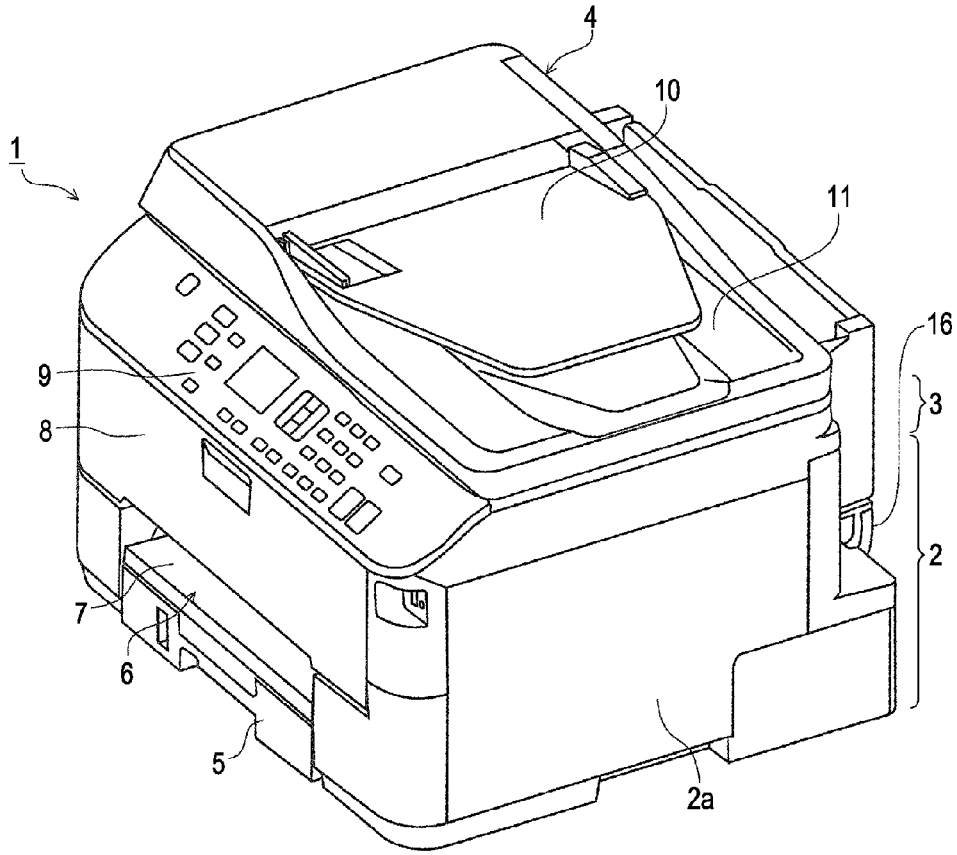
FIG. 1 is a perspective view illustrating an ink jet printer according to the invention when seen from a front side of the apparatus.
Figure 2:
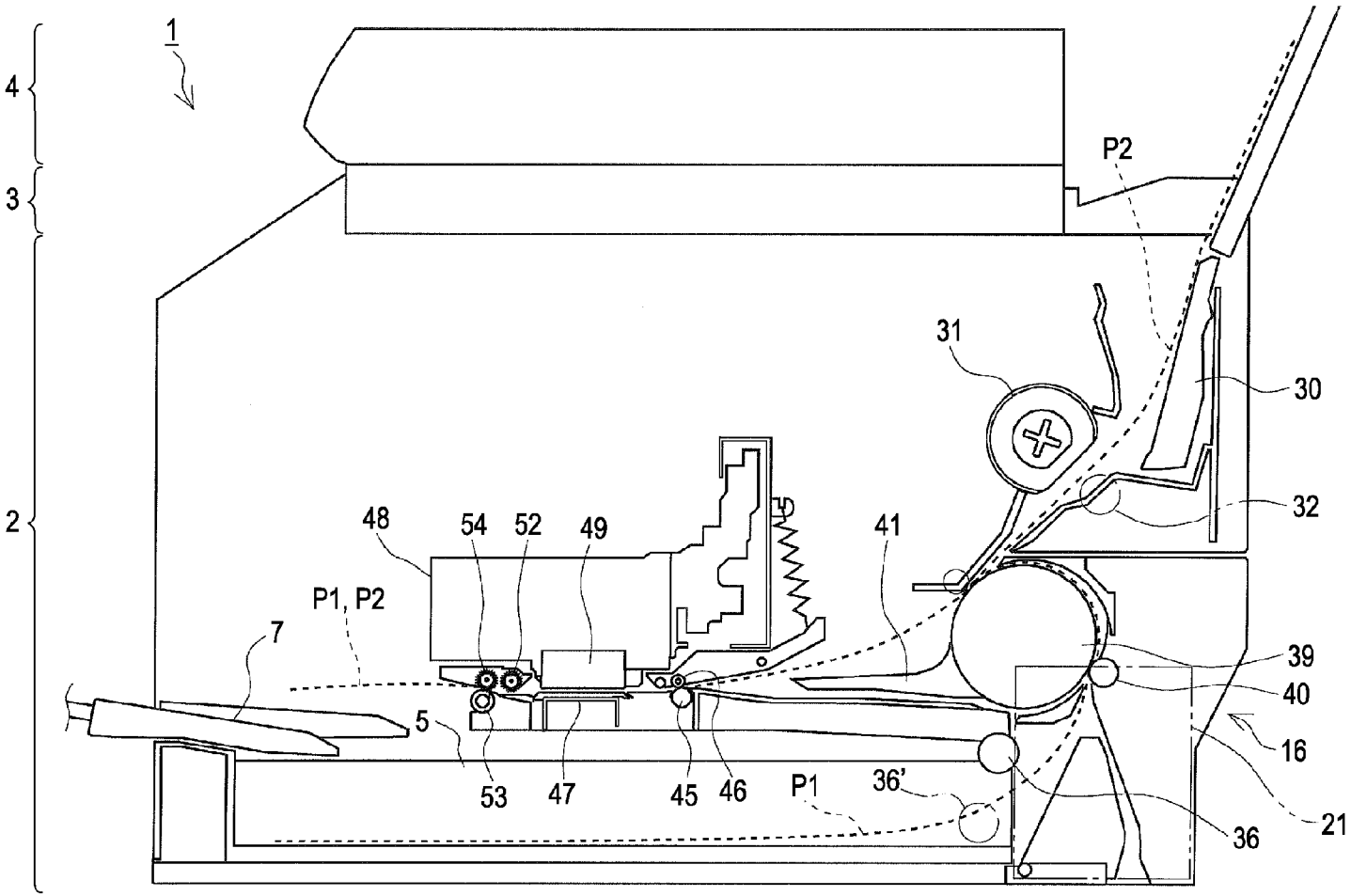
FIG. 2 is a side cross-sectional schematic view illustrating the ink jet printer according to the invention.
Figure 3:
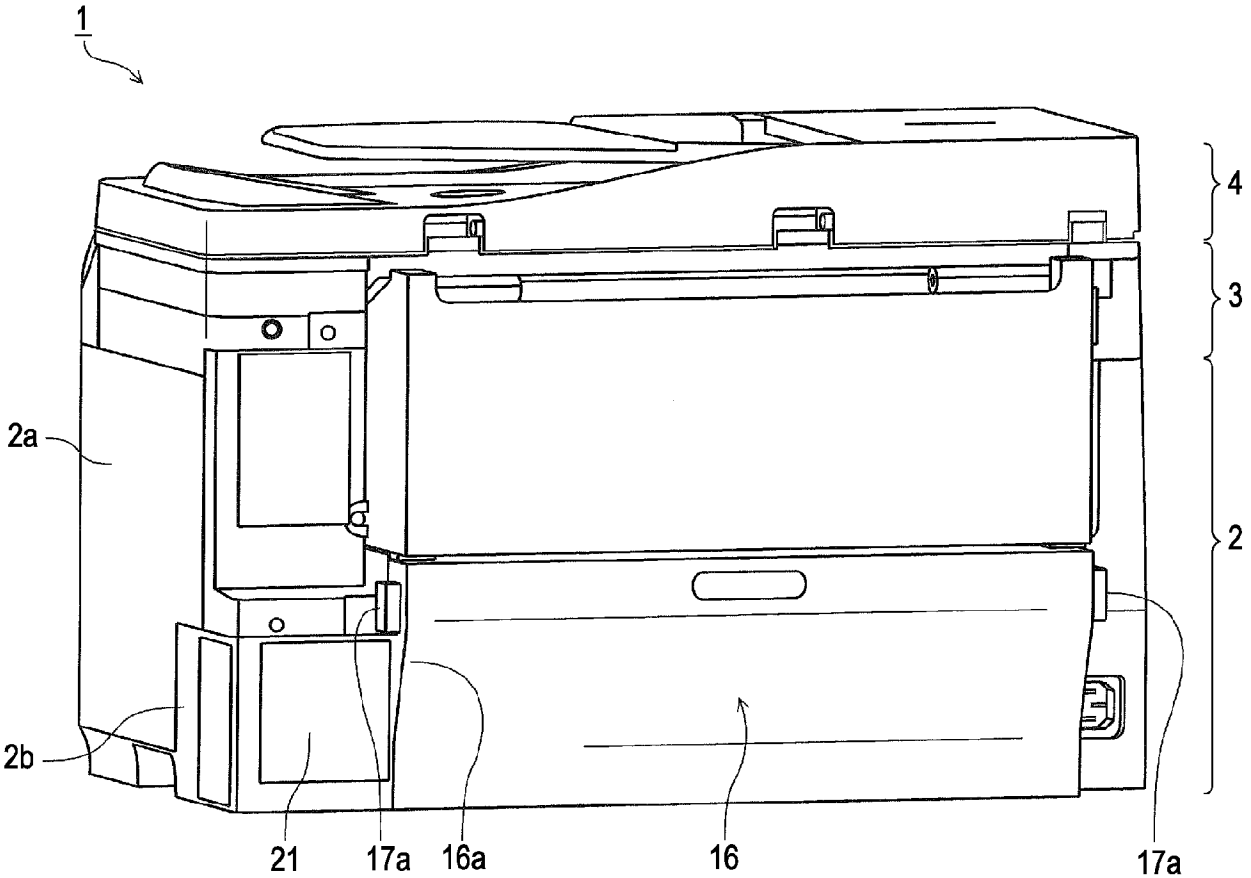
FIG. 3 is a perspective view illustrating the ink jet printer according to the invention when seen from a rear side of the apparatus.
Figure 4:
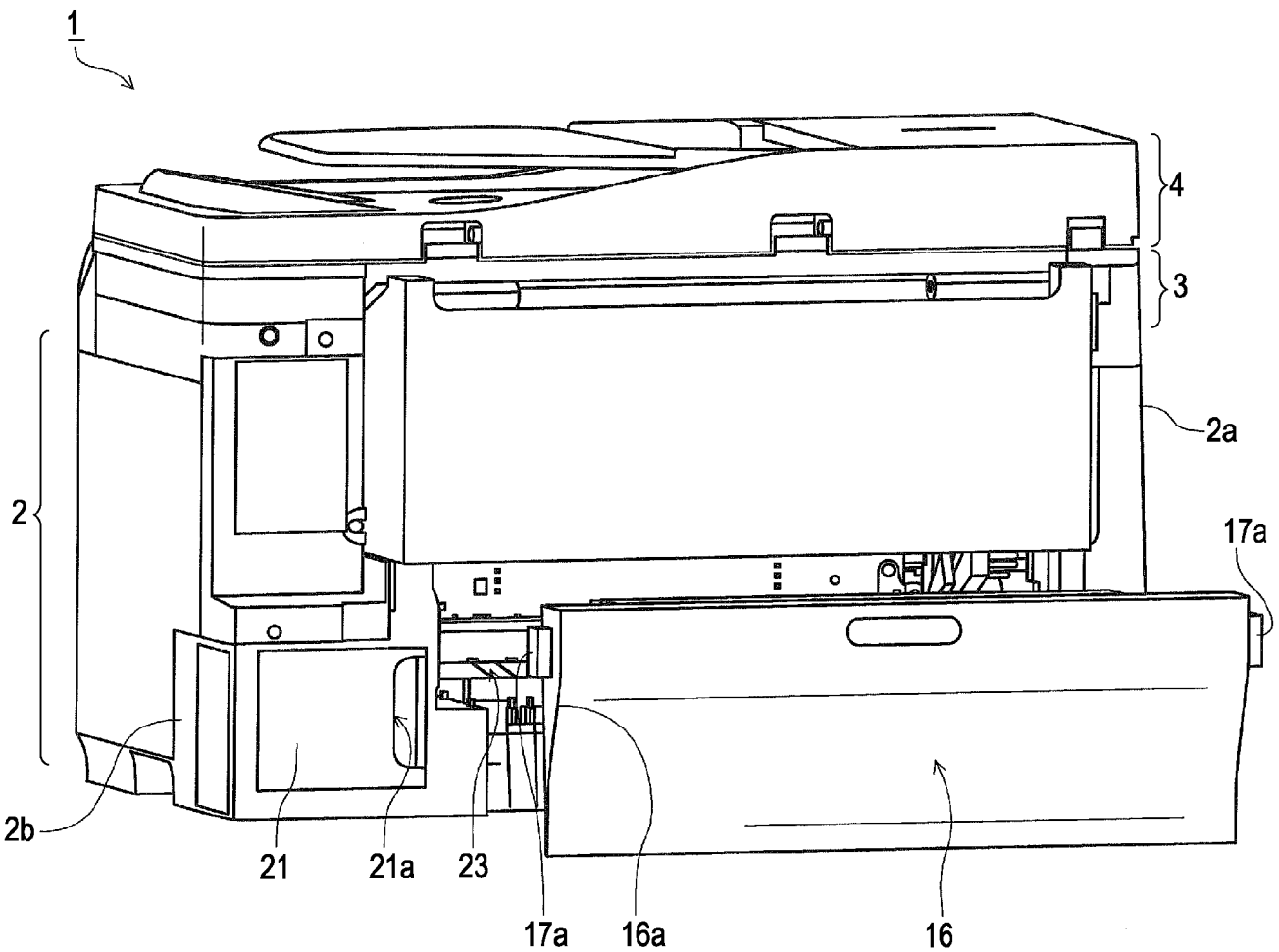
FIG. 4 is a perspective view illustrating the ink jet printer according to the invention when seen from the rear side of the apparatus.
Figure 5:
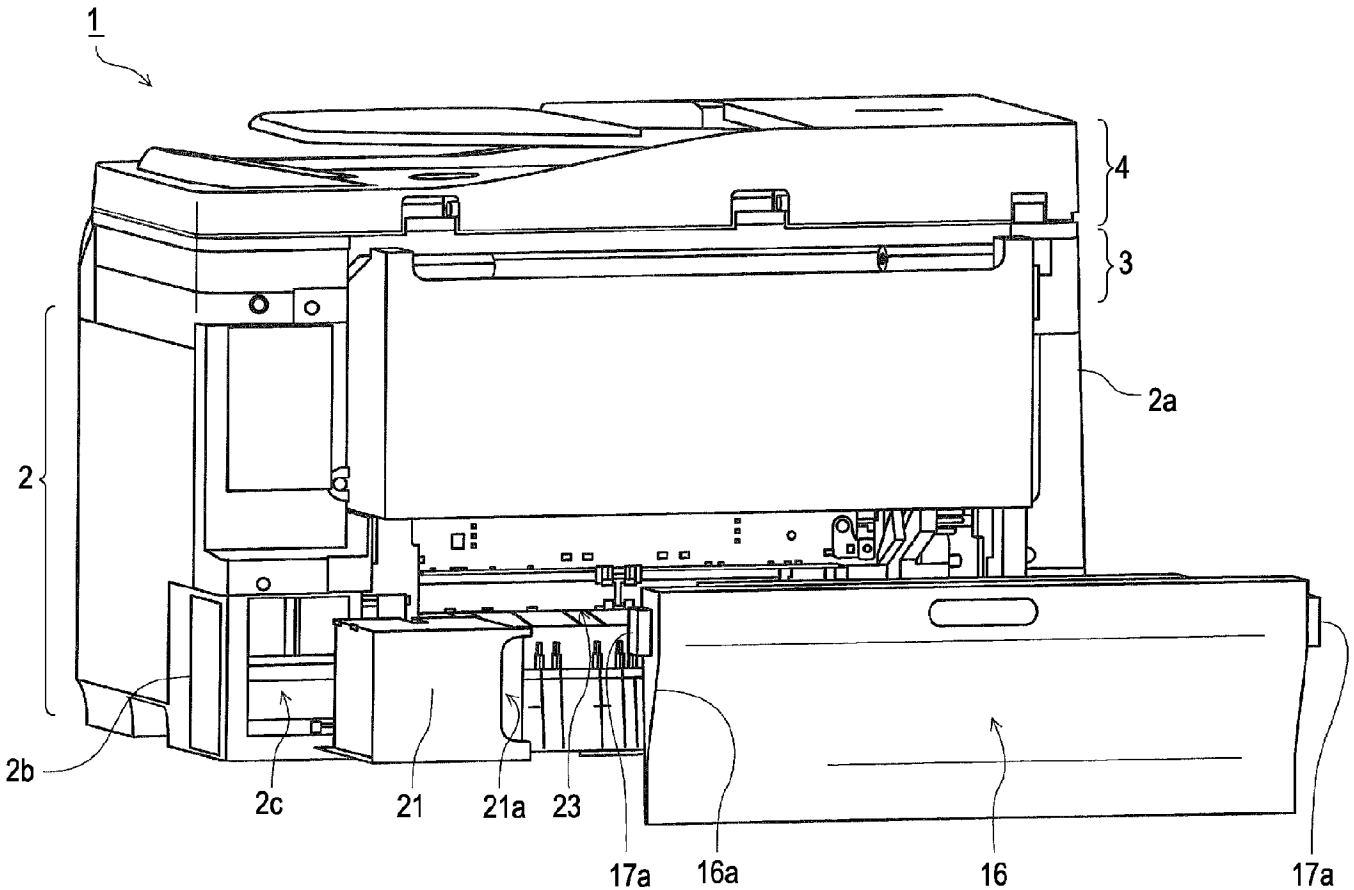
FIG. 5 is a perspective view illustrating the ink jet printer according to the invention when seen from the rear side of the apparatus.

FIG. 1 is a perspective view illustrating a recording apparatus as an example of a liquid ejection apparatus according to the invention, which performs recording on a recording medium, that is, an ink jet printer 1 as an example of the recording apparatus when seen from a front side of the apparatus. FIG. 2 is a side cross-sectional schematic view illustrating the ink jet printer 1. FIG. 3 to FIG. 5 are perspective views illustrating the ink jet printer 1 when seen from a rear side of the apparatus. FIG. 3 illustrates a state where both of a rear unit 16 as an "opening/closing unit" and a waste liquid unit 21 are attached. FIG. 4 illustrates a state where only the rear unit 16 is drawn out. FIG. 5 illustrates a state where both of the rear unit 16 and the waste liquid unit 21 are drawn out.

Figure 6:
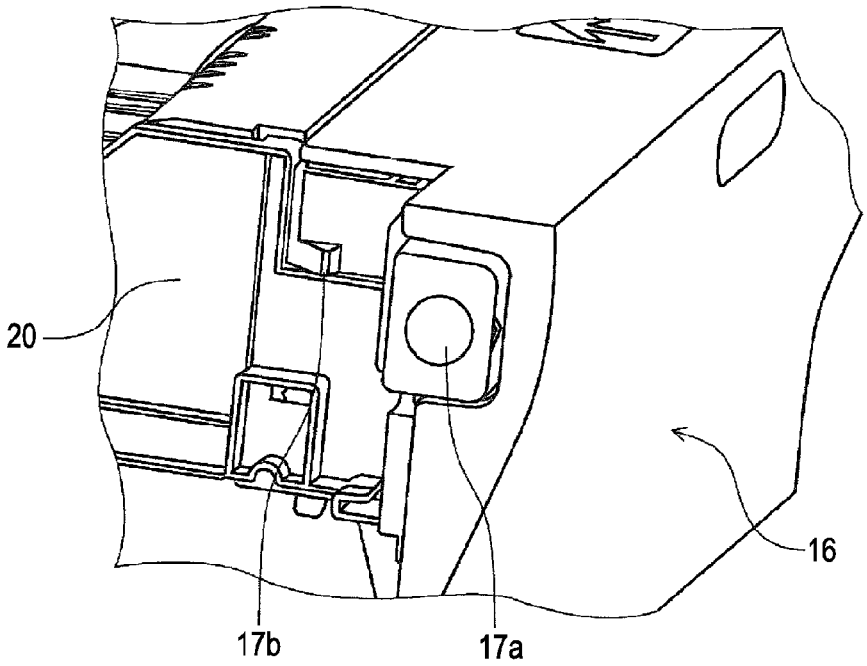
FIG. 6 is a partial enlarged perspective view illustrating a rear unit.
Figure 7:
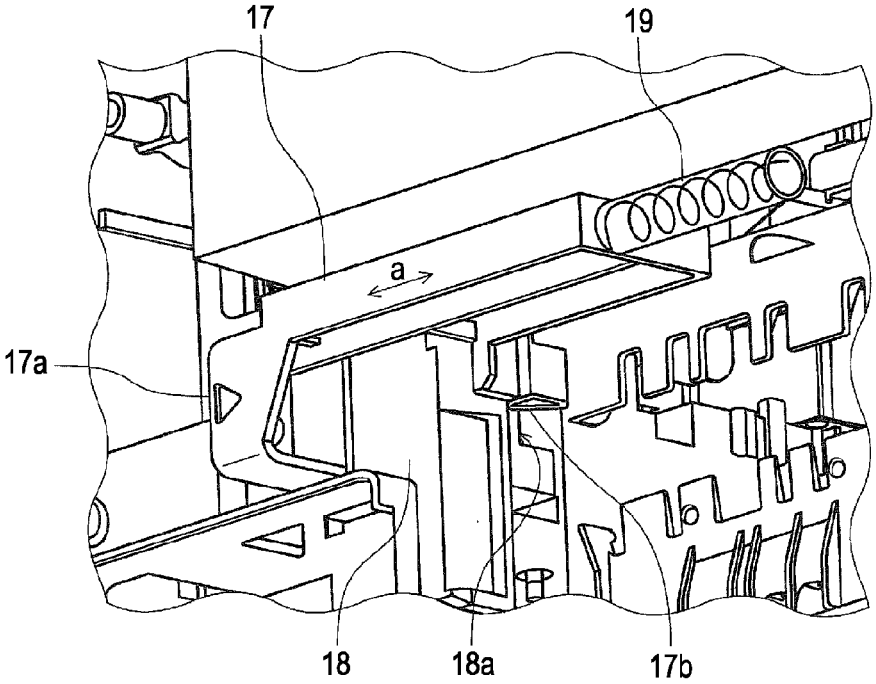
FIG. 7 is a perspective view illustrating a portion on which the rear unit and a printer main body are engaged with each other.
Figure 8:
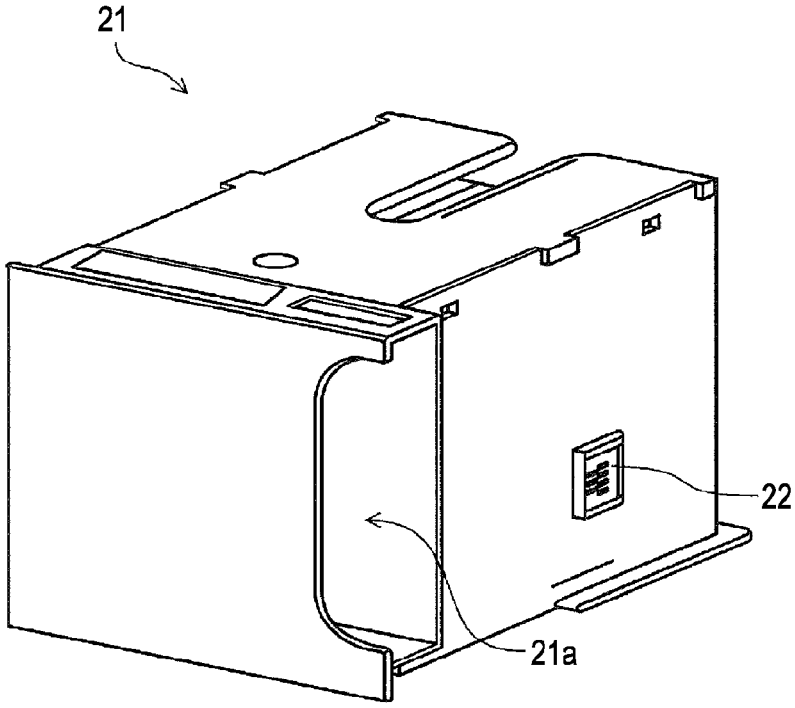
FIG. 8 is a perspective view illustrating a waste liquid unit.
Figure 9A:
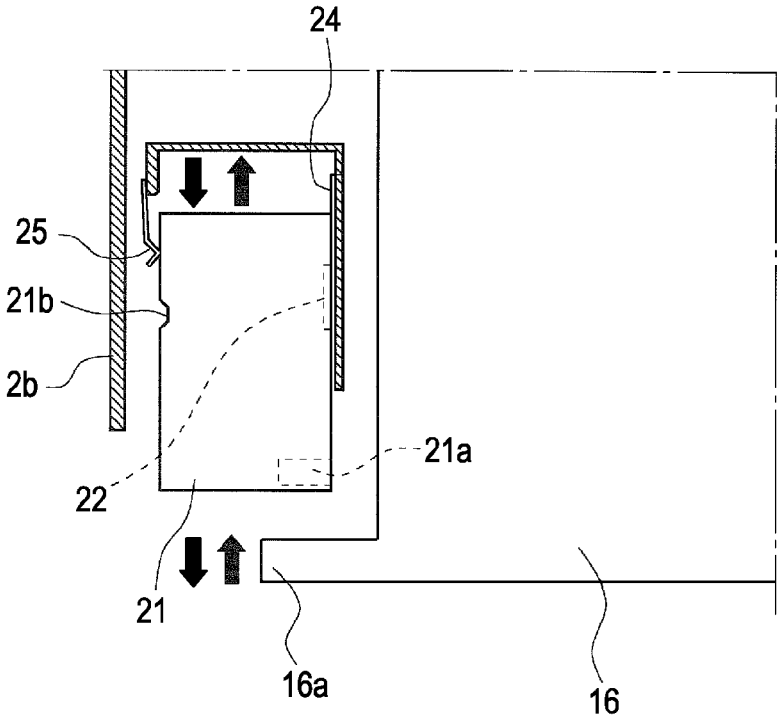
FIGS. 9A and 9B are descriptive views schematically illustrating a configuration of an attachment portion on which the waste liquid unit is attached.
Figure 9B:
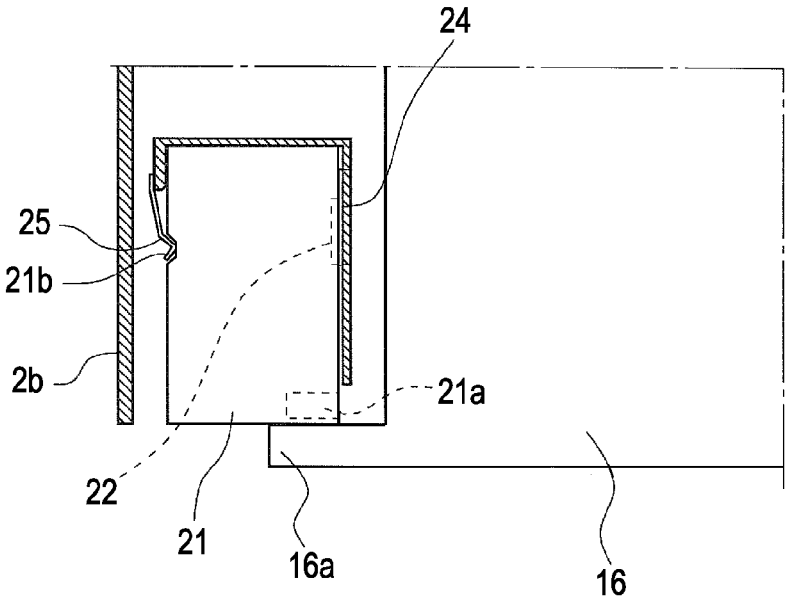

Further, FIG. 6 is a partial enlarged perspective view illustrating the rear unit 16. FIG. 7 is a perspective view illustrating a portion on which the rear unit and a printer main body are engaged with each other. FIG. 8 is a perspective view illustrating the waste liquid unit 21. FIGS. 9A and 9B are descriptive views schematically illustrating a configuration of an attachment portion on which the waste liquid unit 21 is attached. It is to be noted that FIG. 9A illustrates a state before the waste liquid unit 21 and the rear unit 16 are attached (being attached) and FIG. 9B illustrates a state where the waste liquid unit 21 and the rear unit 16 have been attached.

Hereinafter, an entire configuration of the ink jet printer 1 is outlined. In FIG. 1 to FIG. 5, a reference numeral 2 indicates a recording portion which performs ink jet recording on a recording paper. A reference numeral 3 indicates a scanner portion provided at the upper side of the recording portion 2. A reference numeral 4 indicates an automatic document transportation portion provided at the upper side of the scanner portion 3. That is to say, the ink jet printer 1 is configured as a complex machine including a scanner function in addition to an ink jet recording function.

A reference numeral 5 on a front surface of the apparatus indicates a paper cassette on which the recording paper is set and which is provided in a detachable manner. A reference numeral 6 indicates a paper discharge port through which a paper on which recording has been performed is discharged. A reference numeral 7 indicates a discharged paper reception tray which receives the discharged recording paper.

A reference numeral 8 indicates a front cover for exposing a paper transportation path when paper jam occurs. A reference numeral 9 indicates an operation panel which includes a power supply button, operation buttons with which various print settings and recording are executed, a display portion which displays previews of print setting contents and a print image, and the like. Further, a reference numeral 10 on an upper portion of the apparatus indicates a document set tray. A reference numeral 11 indicates a document reception tray which receives a discharged document.

Subsequently, the paper transportation path on the recording portion 2 is outlined with reference to FIG. 2. FIG. 2 is a view schematically illustrating a configuration of the recording portion 2. FIG. 2 does not illustrate all of the configurations, and constituent components which are not necessary for description are not illustrated in FIG. 2.

The recording portion 2 includes two paper feeding paths. One of them is a paper feeding path from the paper cassette 5 provided on a lower portion of the apparatus and the other of them is a paper feeding path from a supporting member 30 provided at a rear side of the apparatus (right side in FIG. 2). It is to be noted that a dashed line P1 indicates a passage trajectory of a paper fed out from the paper cassette 5 and a dashed line P2 indicates a passage trajectory of a paper fed out from the supporting member 30.

A roller indicated by a reference numeral 36, which is provided at a position opposed to the paper cassette 5, is a feeding roller. The feeding roller 36 is provided so as to advance to and retreat from the paper cassette 5 as indicated by a solid line and a virtual line (reference numeral 36'). The feeding roller 36 makes contact with an uppermost paper accommodated in the paper cassette 5 and rotates so as to feed the uppermost paper to the downstream side. The fed paper is reversed by a reverse roller 39 having a large diameter in a curved manner, and then, reaches to a transportation driving roller 45 and a transportation driven roller 46. It is to be noted that a reference numeral 40 indicates a separation roller which separates a paper by nipping the paper between the separation roller and the reverse roller 39.

On the other hand, the supporting member 30 supports a paper in an inclined posture. Further, the supporting member 30 swings about a swing shaft (not illustrated) provided at an upper portion so as to make the feeding roller 31 pressurize an uppermost paper which is supported thereby. The feeding roller 31 rotates so as to feed the pressurized paper to the downstream side. It is to be noted that a reference numeral 32 indicates a separation roller which separates a paper by nipping the paper between the separation roller and the reverse roller 31.

The transportation driving roller 45 and the transportation driven roller 46 are a roller pair which precisely feeds a paper to the downstream side. An ink jet recording head 49 and a supporting member 47 which supports a paper are arranged so as to be opposed to each other at the downstream side of the roller pair.

The recording head 49 is provided on a bottom of a carriage 48 which can reciprocate in the main scanning direction (front-rear direction of a paper plane of FIG. 2). The recording head 49 discharges ink on a paper while moving in the main scanning direction so that recording is performed.

A maintenance unit (not illustrated) is provided at a home position (not illustrated) of the carriage 48. The maintenance unit includes a cap unit (not illustrated) which caps the recording head 49 and a pump unit which generates a negative pressure in the cap unit. The maintenance unit sucks ink from ink discharge nozzles (not illustrated) by generating the negative pressure in the cap in a state where the recording head 49 is capped. Then, the sucked ink is introduced to the waste liquid unit 21, which will be described later, through a tube (not illustrated), as waste liquid.

Next, at the downstream side of the recording head 49, a reference numeral 52 indicates a driven roller which prevents a paper from floating, a reference numeral 53 indicates a discharge driving roller which rotates to discharge a paper, and a reference numeral 54 indicates a discharge driven roller which nips a paper between the discharge driven roller and the discharge driving roller 53. A paper on which recording has been performed is discharged to the discharged paper reception tray 7 with these roller pairs.

A schematic configuration of the ink jet printer 1 is described thus far. Hereinafter, in particular, an attachment configuration of the waste liquid unit 21 is described in detail.

As illustrated in FIG. 3 to FIG. 5, the rear unit 16 and the waste liquid unit 21 are provided on the rear surface of the apparatus in a detachable manner with respect to an apparatus main body 2*a* of the ink jet printer 1 (recording portion 2).

The waste liquid unit 21 is a box-shaped constituent component for reserving waste liquid which has been wastefully ejected from the recording head 49 as described above. The waste liquid unit 21 is attached to an opening 2*c* formed on a housing 2*b* constituting the apparatus main body 2*a*. If the waste liquid unit 21 is attached to the apparatus main body 2*a*, a waste ink reception port (not illustrated) provided on the waste liquid unit 21 and a waste ink discharge port (not illustrated) provided on the apparatus main body 2*a* are connected to each other so that waste ink can be introduced into the waste liquid unit 21.

A recess (hook portion) 21*a* is formed on the waste liquid unit 21 at a right front side as illustrated in FIG. 8. The recess 21*a* serves as a hook when the waste liquid unit 21 is drawn out from the apparatus main body 2*a*. A user inserts his (her) finger into the recess 21*a* so as to draw out the waste liquid unit 21 from the apparatus main body 2*a*. It is to be noted that a portion serving as the hook for drawing out the waste liquid unit 21 is the recess 21*a* only and a recess, a protrusion, or the like serving as the hook other than the recess 21*a* are not formed.

Next, the rear unit 16 as an opening/closing unit is a unit which opens and closes an opening 23 from which the paper transportation path (in the embodiment, upstream side portion of the transportation driving roller 45) is exposed. The opening 23 is closed in a state where the rear unit 16 is attached to the apparatus main body 2*a*.

If paper jam occurs, the front cover 8 at the front side or the rear unit 16 is detached (the opening 23 is opened) so that the paper transportation path is exposed. In particular, in the embodiment, the paper transportation path at the downstream side (left side in FIG. 2) with respect to the transportation driving roller 45 is exposed by opening the front cover 8 and the paper transportation path at the upstream side (right side in FIG. 2) with respect to the transportation driving roller 45 is exposed by detaching the rear unit 16 (by opening the opening 23).

It is to be noted that in the embodiment, the rear unit 16 includes a guide member 41 which forms the paper transportation path and the reverse roller 39. The paper transportation path is largely opened by detaching the rear unit 16.

The rear unit 16 has lock members 17 at both sides. If operation button portions 17*a* formed on ends of the lock members 17 are pressed inward, a lock state of the rear unit 16 to the apparatus main body 2*a* is released.

FIG. 7 illustrates a relationship between the lock member 17 provided on the rear unit 16 and a frame 18 provided on the apparatus main body 2*a*. In FIG. 7, other members constituting the rear unit 16 are not illustrated for convenience of description. The lock members 17 are provided on the rear unit 16 so as to slide in a direction of an arrow "a". Further, the lock members 17 are provided in a state of being biased in the direction of protruding to the outer side (left direction in an example as illustrated in FIG. 7) from both sides by coil springs 19.

Locking hooks 17*b* are formed on the lock members 17. If the locking hooks 17*b* get into recesses 18*a* formed on the frame 18, the rear unit 16 is locked to the apparatus main body 2*a*. Accordingly, the locking hooks 17*b* are disengaged from the recesses 18*a* by pressing the operation button portions 17*a* of the lock members 17 against biasing forces of the coil springs 19 (in the right direction in an example as illustrated in FIG. 7) so that the rear unit 16 can be detached from the apparatus main body 2*a*. It is to be noted that although FIG. 7 illustrates a lock configuration at one side, a lock configuration provided at the other side has the same configuration.

Next, an attachment configuration of the waste liquid unit 21 is described. An IC chip 22 is provided on one side surface of the waste liquid unit 21 as illustrated in FIG. 8. The IC chip 22 holds information relating to an amount of waste liquid reserved in the waste liquid unit 21. In a state where the waste liquid unit 21 is attached to the apparatus main body 2*a*, the IC chip 22 makes electrical contact with a contact 24 provided on the apparatus main body 2*a* as illustrated in FIG. 9B so that a controller (not illustrated) of the ink jet printer 1 can access the IC chip 22.

The controller (not illustrated) increments an expected ink discharge amount to a numerical value indicating an accumulated waste liquid amount held in the IC chip 22 when maintenance is executed on the recording head 49, for example. With this, the controller (not illustrated) can grasp an amount of waste ink reserved in the waste liquid unit 21. When the waste ink amount reaches to an upper limit or an exchange standard slightly smaller than the upper limit of an amount of waste ink which can be reserved in the waste liquid unit 21, the controller issues a warning to a user to exchange the waste liquid unit 21.

The IC chip 22 is not accessible in a state where the waste liquid unit 21 is detached. Therefore, the controller (not illustrated) can detect whether the waste liquid unit 21 is attached or not based on accessibility to the IC chip 22. As a result, a processing operation in which waste ink is generated (for example, maintenance operation on the recording head 49) is set so as not to be performed when the waste liquid unit 21 is not attached, for example. This makes it possible to prevent the waste ink from flowing out in the apparatus.

On the other hand, a recess 21*b* is formed on the other side surface of the waste liquid unit 21 as illustrated in FIGS. 9A and 9B. A leaf spring 25 as a biasing unit which gets into the recess 21*b* is provided on the apparatus main body 2*a*. In a state where the waste liquid unit 21 is attached to the apparatus main body 2*a*, the leaf spring 25 gets into the recess 21*b* so that an attachment state of the waste liquid unit 21 is held. In addition, the leaf spring 25 biases the waste liquid unit 21 in a right upward direction in FIGS. 9A and 9B. With this, a contact state between the IC chip 22 and the contact 24 is kept to be preferable.

As illustrated in FIG. 3 and FIG. 9B, a side end portion 16*a* as a part of the rear unit 16 is located at a position at the front side on a draw-out path of the waste liquid unit 21 from the apparatus main body 2*a* and covers a part of the waste liquid unit 21 in a state where the rear unit 16 is attached. Further, in the embodiment, the side end portion 16*a* covers the recess (hook portion) 21*a* serving as a hook when the waste liquid unit 21 is drawn out.

With the above configuration, the waste liquid unit 21 cannot be drawn out in the state where the rear unit 16 is attached. In order to draw out the waste liquid unit 21, the rear unit 16 needs to be detached (the opening 23 needs to be opened) first.

Hereinafter, action effects obtained by the above configuration are described. An exchange frequency of the waste liquid unit 21 is extremely less than an exchange frequency of an ink cartridge (not illustrated), for example. However, since the waste liquid unit 21 reserves waste ink, there arises risks that a user's hand may become dirty at the time of the exchange and an inner portion of the apparatus may possibly be contaminated. In addition, if the waste liquid unit 21 is detached carelessly while the maintenance operation is being executed on the recording head 49, there arises a risk that waste liquid flows out into the apparatus from an ink tube (not illustrated) that is introducing the waste liquid to the waste liquid unit 21.

In addition, if the waste liquid unit 21 is drawn out while information is being written into the IC chip 22, the information cannot be written into the IC chip 22 properly. Then, the waste ink reservation amount in the waste liquid unit 21 cannot be grasped properly. As a result, there arises a risk that waste liquid overflows in the apparatus.

Accordingly, it is preferable that attachment and detachment of the waste liquid unit 21 be performed requisite minimum times at appropriate timings essentially and the waste liquid unit 21 should not be drawn out carelessly and easily. Then, in the invention, a part of the waste liquid unit 21 is covered by the rear unit 16 which is to be detached when an irregular and infrequent event of a paper jam processing occurs. With this configuration, the waste liquid unit 21 can be prevented from being carelessly and easily drawn out.

It is to be noted that the rear unit 16 exposes the paper transportation path therefrom for performing the paper jam processing and is not a cover dedicated to the waste liquid unit 21. Therefore, cost of the apparatus is not increased.

Further, since the rear unit 16 exposes the paper transportation path therefrom for performing the paper jam processing, a paper cannot be transported properly in a state where the rear unit 16 is being opened. That is to say, if the paper is transported in the state where the rear unit 16 is opened, the paper may be undesirably discharged from the opening 23. Accordingly, a user can easily recognize that the rear unit 16 is being opened.

Therefore, a recording operation on the paper can be prevented from being performed continuously for a long period of time in a state where the waste liquid unit 21 is drawn out. With this, a large amount of waste ink is prevented from being flown out in the apparatus. In addition, a sensor dedicated to detect an opening and closing state of the rear unit 16 is not required to be provided.

In addition, in the embodiment, the recess 21*a* serving as a hook when the waste liquid unit 21 is drawn out is covered by the rear unit 16. Therefore, the waste liquid unit 21 can be prevented more effectively from being carelessly and easily drawn out.

Figure 10A:
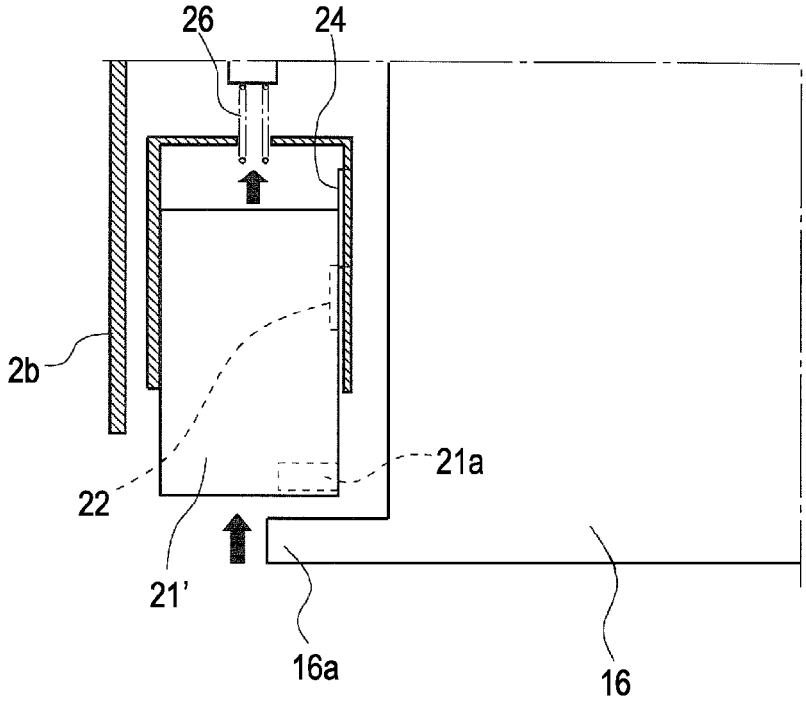
FIGS. 10A and 10B are descriptive views schematically illustrating a configuration of the attachment portion on which the waste liquid unit is attached (another embodiment).
Figure 10B:
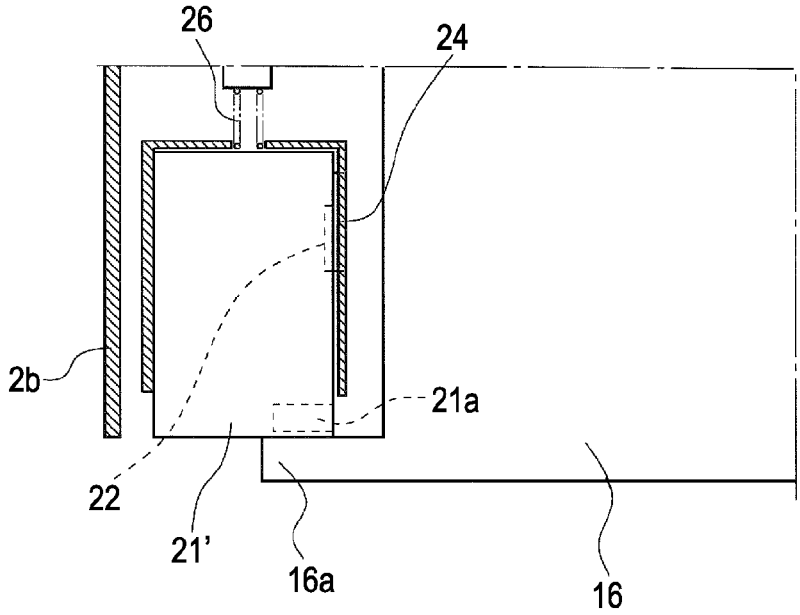

Subsequently, another embodiment of the invention is described with reference to FIGS. 10A and 10B. FIGS. 10A and 10B correspond to FIGS. 9A and 9B. The embodiment as illustrated in FIGS. 10A and 10B is different from the embodiment as illustrated in FIGS. 9A and 9B in the following points. That is, in the embodiment as illustrated in FIGS. 10A and 10B, a waste liquid unit 21' is provided in a state of being biased in a detachment direction (draw-out direction) by a coil spring 26 as a biasing unit. Further, the waste liquid unit 21' is engaged with the side end portion 16*a* of the rear unit 16 in a closed state so as to be fixed at an attachment position on the apparatus main body 2*a*.

That is to say, in the embodiment, the waste liquid unit 21 cannot be made in an attached state by itself and needs to be surely engaged with (pressed by) the rear unit 16. Therefore, the IC chip 22 provided on the waste liquid unit 21 can be used not only as a unit which detects whether the waste liquid unit 21 is attached or not but also as a unit which detects an opening and closing state of the rear unit 16.

It is to be noted that a distance from an arrangement position of the locking hook 17*b* which locks the rear unit 16 in the attached state to the side end portion 16*a* which covers the waste liquid unit 21 is preferably shorter from a viewpoint of holding the waste liquid unit 21 reliably. In the embodiment, the position of the locking hook 17*b* is set to a position which is at an outer side of the apparatus (left side in FIGS. 9A and 9B) with respect to a contact position between the IC chip 22 and the contact point 24. Therefore, the rear unit 16 is locked at a position considerably closer to the side end portion 16*a* which covers the waste liquid unit 21. With this, the waste liquid unit 21 can be held at an attachment position reliably.

The embodiments as described above are merely examples and the invention is not limited to the embodiments. For example, in the embodiments, the rear unit 16 is attached to and detached from the apparatus main body 2*a* so as to open and close the opening 23 from which the paper transportation path is exposed. However, for example, the rear unit 16 may be provided on the apparatus main body 2*a* in a rotationally movable or slidable manner so as to open/close the opening 23 by rotating or sliding the rear unit 16.

Further, in the above embodiments, the rear unit 16 opens and closes the opening from which the paper transportation path is exposed, and the waste liquid unit 21 is engaged with such rear unit 16. However, the invention is not limited thereto. Alternatively, a part of another opening/closing unit (for example, another opening/closing unit provided on a printer, such as a cover which opens and closes an attachment port of an ink cartridge) may be located on a draw-out path of the waste liquid unit 21 and cover at least a part of the waste liquid unit 21.

Further, in the above embodiments, the invention is applied to a recording apparatus as an example of a liquid ejection apparatus and an ink jet printer as an example of the recording apparatus. However, the invention can be also applied to other liquid ejection apparatuses which are generally used.

The liquid ejection apparatus is not limited to a recording apparatus in which an ink jet recording head is used and which discharges ink from the recording head so as to perform recording on a recording medium, such as a printer, a copying machine, a facsimile and so on. Alternatively, the liquid ejection apparatus includes an apparatus which ejects liquid based on the usage thereof instead of ink onto a recording medium from a liquid ejection head corresponding to the ink jet recording head so as to make the liquid adhere to the recording medium.

The liquid ejection head includes a color material ejection head used for manufacturing a color filter for a liquid crystal display, an electrode material (conductive paste) ejection head used for forming an electrode of an organic electroluminescence (EL) display and a field emission display (FED), a bioorganic material ejection head used for manufacturing a biochip, a specimen ejection head as a precision pipette, and the like in addition to the above recording head.

The entire disclosure of Japanese Patent Application No. 2011-42296, filed Feb. 28, 2011 is expressly incorporated by reference herein.

What is claimed is:

1. A liquid ejection apparatus comprising:

a main body;

a liquid ejection head which is provided on the main body and ejects liquid onto a recording medium;

a maintenance unit including a cap unit which caps the liquid ejection head and a pump unit which sucks liquid from the liquid ejection head;

a feed tray which is mounted into the main body in a detachable manner, and provides the recording medium to a transportation path which is communicated toward the liquid ejection head;

a draw-out path which is provided on the main body;

a waste liquid unit which communicates to the maintenance unit, and is provided on the draw-out path in a detachable manner and reserves waste liquid wastefully ejected from the liquid ejection head, wherein the waste liquid unit is separately detachable from the main body;

an opening from which the transportation path for transporting the recording medium is exposed; and an opening/closing unit which is capable of opening and closing the opening, and covers at least a part of the waste liquid unit in a state where the waste liquid unit is attached to the draw-out path and the opening is closed, the opening/closing unit being separate from the feed tray and being located on an opposite side of a feed tray mounting side of the main body.

2. The liquid ejection apparatus according to claim 1, wherein the opening/closing unit forms a part of the transportation path.

3. The liquid ejection apparatus according to claim 1, wherein the waste liquid unit has a hook portion serving as a hook when the waste liquid unit is drawn out, and the opening/closing unit covers the hook portion in a state of the opening being closed.

4. The liquid ejection apparatus according to claim 1, further including a biasing unit which biases the waste liquid unit in a detachment direction, wherein in a state where the opening/closing unit closes the opening, the waste liquid unit is engaged with the opening/closing unit so as to be attached to the main body.

5. The liquid ejection apparatus according to claim 1, wherein a memory unit which holds information relating to an amount of waste liquid reserved in the waste liquid unit is provided on the waste liquid unit, and the waste liquid unit is accessible to the memory unit when the waste liquid unit is attached to the main body of the liquid ejection apparatus.

* * * * *